US006529111B1

(12) United States Patent
Kimata et al.

(10) Patent No.: US 6,529,111 B1
(45) Date of Patent: Mar. 4, 2003

(54) IGNITION COIL

(75) Inventors: Ryuichi Kimata, Wako (JP); Kazutomo Nishida, Wako (JP); Naoya Toida, Wako (JP)

(73) Assignee: Honda Giken Kogyo Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/577,989

(22) Filed: May 25, 2000

(30) Foreign Application Priority Data

Aug. 31, 1999 (JP) ..... 11-245980
Aug. 31, 1999 (JP) ..... 11-245981

(51) Int. Cl.[7] ..... H01F 27/28

(52) U.S. Cl. ..... 336/182; 336/182; 336/96; 336/192; 123/633; 123/634; 123/635; 123/148; 123/149

(58) Field of Search ..... 336/182, 96, 192; 123/633, 634, 635, 148, 149, 647, 665

(56) References Cited

U.S. PATENT DOCUMENTS 4,181,114 A * 1/1980 Carlsson et al. ..... 123/148
4,514,712 A * 4/1985 McDougal ..... 336/96
5,170,767 A * 12/1992 Wada et al. ..... 123/633
5,558,074 A * 9/1996 Fukatsu et al. ..... 123/647
5,692,483 A * 12/1997 Wada et al. ..... 123/634

* cited by examiner

*Primary Examiner*—Elvin Enad
*Assistant Examiner*—Jennifer A Poker
(74) *Attorney, Agent, or Firm*—Arent Fox Kintner Plotkin and Kahn

(57) ABSTRACT

In an ignition coil for an internal combustion engine, the primary coil and the secondary coil of the coil unit are fabricated of self-welding wire and fixed in a coil case by an elastic material and an ignition control circuit unit is fixed in the coil case by an elastic material. Similarly, the primary coil and the secondary coil are integrally joined by an adhesive. The terminal of the primary coil and the lead of the ignition control circuit unit are joined together by fusion and the joint is partially molded, while the terminal of the secondary coil and the terminal of a high-tension cord outlet are joined together by fusing and the joint is partially molded. Moreover, the coil case is provided with an inner cap such that the fusing and partial molding of the terminals can be conducted on the inner cap, thereby ensuring a high recycle rate and enabling efficient resource recovery and reuse.

11 Claims, 3 Drawing Sheets

IGNITION COIL

BACKGROUND OF THE INVENTION

1. Field of the Invention

This invention relates to an ignition coil, particularly to an ignition coil with an improved recycle rate.

2. Description of the Related Art

The desirability of efficiently recovering and reusing resources, i.e., recycling, has gained wide recognition in many fields. This is also true in the field of ignition coils used in internal combustion engines. Such ignition coils are required to have high resistance to vibration, moisture, heat and the like. Their coil units are therefore usually fixed by charging a thermosetting resin (e.g. an epoxy resin) into a coil case holding the coil unit to embed the coil unit in the resin. This fixing of the coil unit by embedding it in resin makes conventional ignition coils hard to disassemble at the time of disposal. They are simply disposed of, without any disassembly and, therefore, are low in recycle rate.

SUMMARY OF THE INVENTION

An object of this invention is to overcome this problem by providing an ignition coil improved in recycle rate and thus enabling efficient recovery and reuse of resources.

In order to achieve the object, there is provided, in a first aspect of the invention, an ignition coil having a core, a coil unit composed of a primary coil and a secondary coil disposed around the core and a coil case housing the core and the coil unit, the core being openable at one end such that the coil unit is detachable from the core, wherein the primary coil and the secondary coil of the coil unit are fabricated of self-welding wire and fixed in the coil case by an elastic material.

In a second aspect of the invention, there is provided an ignition coil having a coil unit composed of a primary coil with a terminal and a secondary coil, an ignition control circuit unit with a lead to be connected to the terminal of the primary coil and a coil case housing the coil unit and the ignition control circuit unit, wherein the terminal of the primary coil and the lead of the ignition control circuit unit are joined together by fusion and the joint is partially molded.

BRIEF DESCRIPTION OF THE DRAWINGS

The above and other objects and advantages of the invention will be more apparent from the following descriptions and drawings, in which.

DETAILED DESCRIPTION OF THE PREFERRED EMBODIMENT

An ignition coil that is an embodiment of this invention will now be explained with reference to the drawings.

Figure 1:
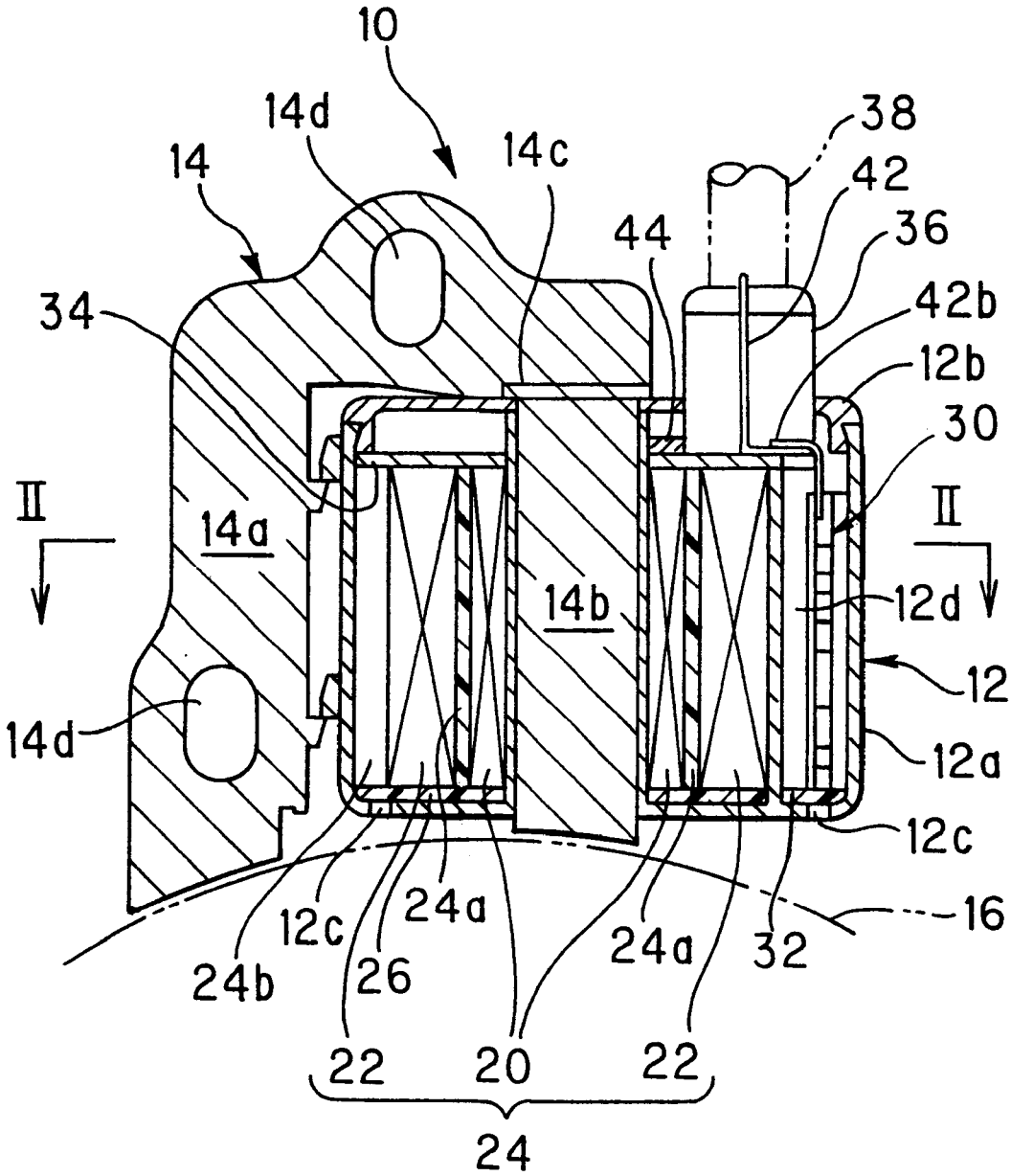
FIG. 1 is a side sectional view of an ignition coil according to this invention.
Figure 2:
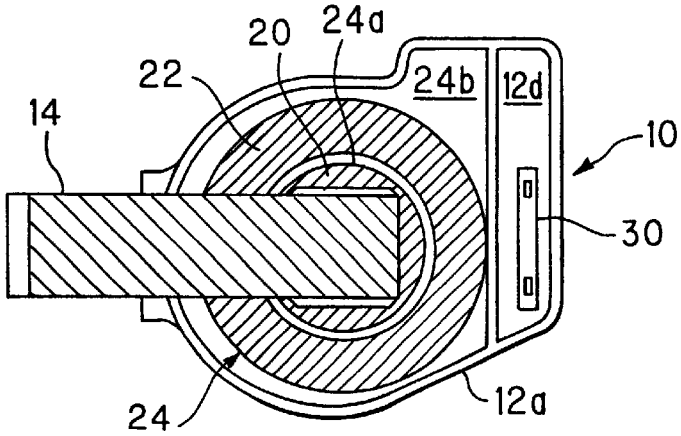
FIG. 2 is a sectional view taken along line II—II in FIG. 1.
Figure 3:
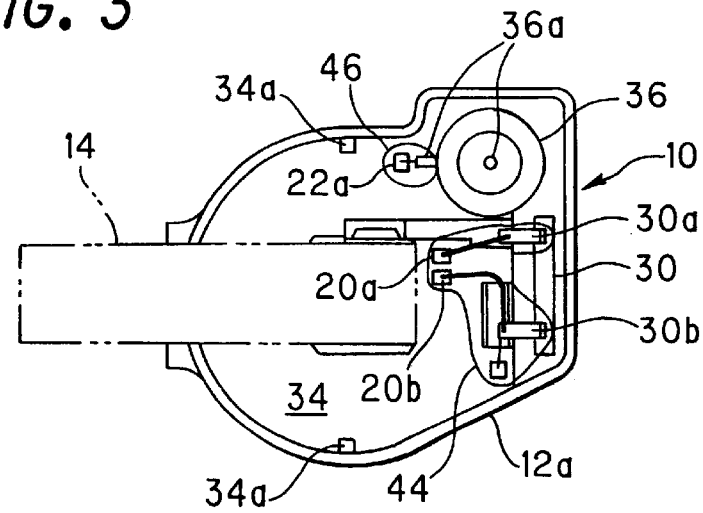
FIG. 3 is a top view of the ignition coil shown in FIG. 1 with the cover of the main case unit removed.
Figure 4:
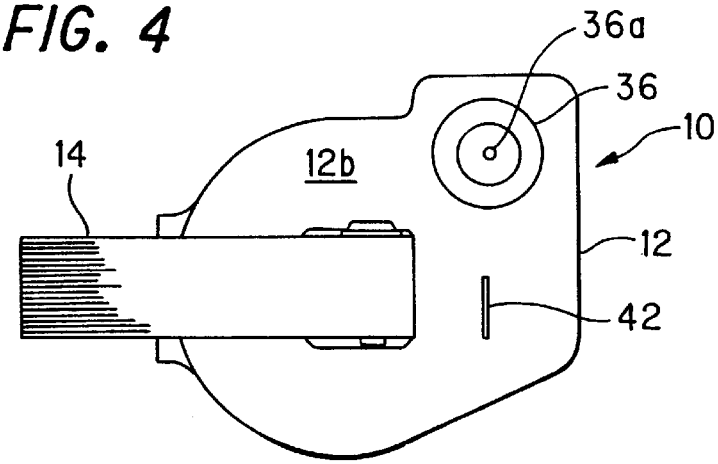
FIG. 4 is a top view of the completely assembled ignition coil after attachment of the main case unit cover.

FIG. 1 is an explanatory side sectional view of the ignition coil. FIG. 2 is a sectional view taken along line II—II in FIG. 1. FIG. 3 is a top view of the ignition coil shown in FIG. 1 with the cover of the main case unit removed. FIG. 4 is a top view with the cover attached (in the condition shown in FIG. 1).

The ignition coil of this embodiment, designated by reference numeral 10 in the drawings, comprises an outer case (coil case) 12 and a core (iron core) 14, generally C-shaped in section, attached to the outer case 12.

The outer case 12 is composed of a main case unit 12*a*, generally cylindrical in shape, and is openable at one end and a case cover 12*b* for closing the open end of the main case unit 12*a*. The main case unit 12*a* and the case cover 12*b* are both made of PBT (polybutylene terephthalate). The outer case 12 has a water drain hole 12*c*.

The core 14 is composed of an inverted L-shaped section core piece 14*a* and an I-shaped section core piece 14*b*. They are openable at one end 14*c*.

The core 14 is attached to the outer case 12 by inserting the core piece 14*b* into a through-hole at the center of the main case unit 12*a* of the outer case 12, attaching the case cover 12*b* and then mounting the core piece 14*a*.

The core 14 is cut away at the end portion opposite to one end 14*c* such that the cut end portions face a circular flywheel 16 of an internal combustion engine (not shown) that rotates in close proximity thereto, and the core 14 is given the same curvature as the flywheel 16 so as to maintain uniform spacing from the flywheel 16. The core 14 thus uses the flywheel 16 to form a closed magnetic circuit.

The core 14 is made of laminated gradient silicon steel plate members. The silicon content of gradient silicon steel plate is skewed toward the surfaces. This makes it superior in core loss property and magnetic saturation property to ordinary grain-oriented silicon steel plate with uniform silicon distribution. The core 14 is formed with mounting holes 14*d*.

A coil unit 24 composed of a primary coil 20 and a secondary coil 22 is housed in the outer case 12. The primary coil 20 is disposed around the core piece 14*b* of the core 14 and, as best shown in FIG. 2, the secondary coil 22 is disposed around the primary coil 20.

Both the primary coil 20 and the secondary coil 22 are fabricated of self-welding wire 200 made of PIW. (self-welding wire, also called cementing enamel wire, comprises of any of various enamel wires surface-coated with a self-welding layer.)

Figure 5:
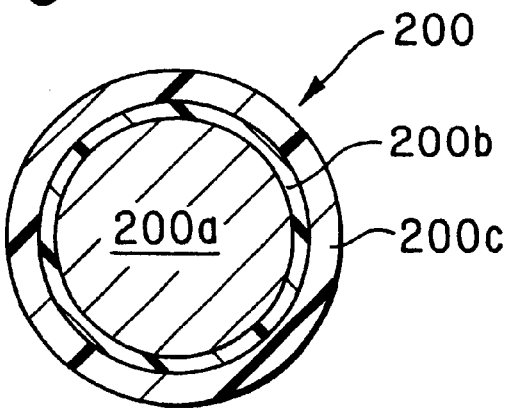
FIG. 5 is a sectional view schematically illustrating a self-welding wire used in the coil unit of the ignition coil shown in FIG. 1.

As illustrated schematically in FIG. 5, the self-welding wire 200 is composed of a copper wire 200*a*, an insulating layer 200*b* formed on the peripheral surface of the copper wire 200*a*, and a self-welding layer 200*c* formed on the peripheral surface of the insulating layer 200*b*.

Figure 6:
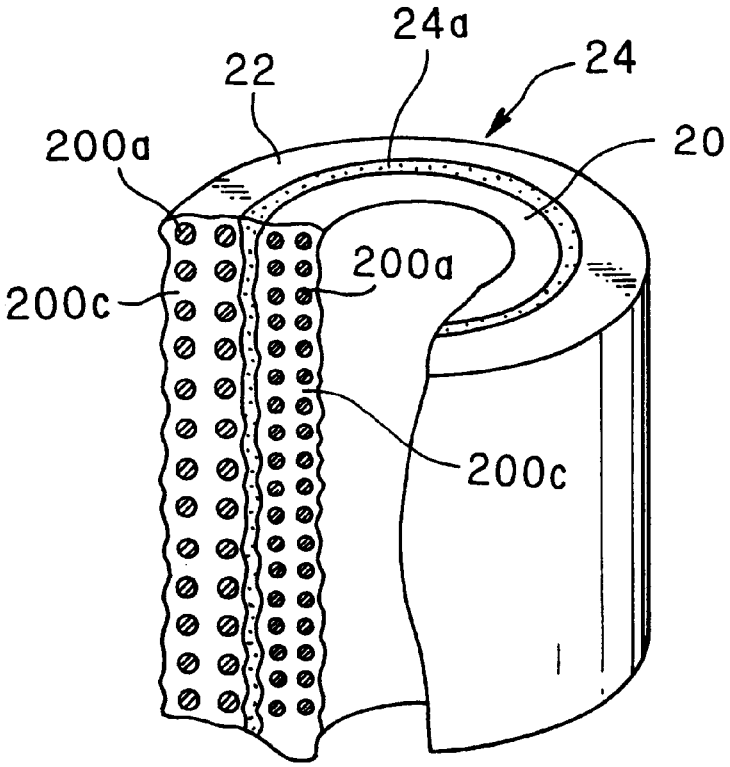
FIG. 6 is a perspective view schematically illustrating the fabrication of the ignition coil shown in FIG. 1.

Each of the primary coil 20 and the secondary coil 22 is fabricated by winding self-welding wire 200 around a rod (not shown), heating the result, and then cooling it to form the cylindrical shape schematically illustrated in FIG. 6. The two coils are then integrally bonded with an adhesive 24*a* to complete the coil unit 24. The use of the self-welding wire 200, allows the primary coil 20 and the secondary coil 22 to be easily fabricated without use of a bobbin.

The adhesive 24*a* is, for example, a hotmelt adhesive with a base of polyamide, EVA (ethylene-vinyl acetate) or polyolefin, of a thermoplastic polymer, can be used.

The coil unit 24 composed of the primary coil 20 and the secondary coil 22 fabricated in the foregoing manner is fixed to the floor or bottom of the main case unit 12*a* using an elastic material 26. The elastic material 26 is a material, such as silicon gel, that is excellent in absorbing vibration and is also adhesive.

Thus the coil unit 24 is not fixed in the main case unit 12*a* by being embedded in the resin of a resin molding, but is fixed in the main case unit 12*a* by the elastic material 26. An unfilled space 24*b* therefore remains between the coil unit 24 and the main case unit 12*a*.

One side portion of the main case unit 12*a* is partitioned to form a compartment 12*d*. An ignition control circuit unit 30 is housed in the compartment 12*d*. Similarly to the coil unit 24, the ignition control circuit unit 30 is fixed to the floor or bottom of the main case unit 12*a* by a similar elastic material 32.

The ignition control circuit unit 30 is composed of a waveshaping circuit, a switching element (power transistor) and the like. It is responsive to commands from a control unit (not shown) for passing current from a battery power source (not shown) through the primary coil 20 and cutting off the current supply at a prescribed time point so as to induce ignition voltage in the secondary coil 22. This operation is well known in the art.

The ignition control circuit unit 30 is fabricated on a ceramic board and, as shown in FIG. 3, is equipped with two leads 30*a*, 30*b* for connecting the primary coil 20 to the battery power source and ground. The leads 30*a*, 30*b* are made of brass.

An inner cap 34 is installed in the vicinity of the open end of the main case unit 12*a*. The inner cap 34 contacts the coil unit 24 and presses it against the floor of the main case unit 12*a*. Like the main case unit 12*a*, the inner cap 34 is also made of PBT. The inner cap 34 is formed with a water drain hole 34*a*.

At a region upward of the compartment 12*d* of the outer case 12, the inner cap 34 protrudes in a cylindrical shape to form a high-tension cord outlet 36. A high-tension cord 38 (shown partially by phantom lines in FIG. 1) is inserted into the outlet 36. The high-tension cord outlet is equipped with a terminal 36*a* of L-shaped section (made of brass) for connection with the secondary coil 22. The upper end of the terminal 36*a* is shown in FIG. 3.

The ignition coil 10 of this embodiment is equipped with a stop terminal 42. The stop terminal 42 contacts a lead 42*b* and, when pressed by an operator, causes an associated circuit (not shown) to terminate ignition, thereby immediately stopping the engine.

The connection between the primary coil 20 and the leads 30*a*, 30*b* of the ignition control unit 30 is best shown in FIG. 3. The leads 30*a*, 30*b* extending from the ignition control circuit unit 30 are respectively joined to terminals 20*a*, 20*b* of the primary coil 20 by fusion. Specifically, a large current is passed through the terminal 20*a* (20*b*) and the lead 30*a* (30*b*) while they are pressed together. They are fused and joined by the resulting heat. Each joint is fixed by partial molding with a molding material 44 (the thickness of the molding material 44 is exaggerated in FIG. 1).

In other words, the terminals 20*a*, 20*b* and the leads 30*a*, 30*b* are joined without use of a lead-containing solder and each joint portion is partially molded with the molding material 44.

Similarly, the terminal 22*a* of the secondary coil 22 and the terminal 36*a* of the high-tension cord outlet 36 (the lower side of the sectionally L-shaped body) are also joined by fusion and then fixed by partial molding with a molding material 46. The other terminal of the secondary coil 22 is connected to the primary coil 20 at a point not visible in the drawings.

The molding materials 44, 46 can be made of the same hotmelt adhesive as the adhesive 24*a*.

Since the connection work can be carried out on the inner cap 34, the inner cap 34 can be used as a working surface. In other words, the inner cap 34 formed integrally with the high-tension cord outlet 36 is disposed in the coil case (in the main case unit 12*a*) on the side of the terminals 20*a*, 20*b* of the primary coil 20 and the secondary coil 22 such that the aforesaid fusion and partial molding are conducted on the inner cap 34. This facilitates the connection work, simplifies this step of the fabrication, and enhances reliability.

The process of producing the ignition coil 10 will now be explained.

First, the main case unit 12*a*, the case cover 12*b* and the inner cap 34 are fabricated of PBT, and the core pieces 14*a* and 14*b* are fabricated from gradient silicon steel plate members. The primary coil 20 and the secondary coil 22 are fabricated using self-welding wire 200 in the manner described earlier and are then bonded by the adhesive 24*a* to obtain the coil unit 24. The ignition control circuit unit 30 is fabricated as a ceramic circuit board.

The elastic materials 26, 32 are then formed on the floor or bottom of the main case unit 12*a* by coating, whereafter the coil unit 24 and the ignition control circuit unit 30 are inserted into the main case unit 12*a* to be fixed thereto. Next, the inner cap 34 is attached, the terminals are joined by fusion, and the molding materials 44, 46 are molded (coated) on the joints.

After the case cover 12*b* has been attached, the core 14 is inserted to complete fabrication of the ignition coil 10. The completed ignition coil 10 is mounted at the prescribed location on the engine using the mounting holes 14*d* and appropriate fastening members. The high-tension cord 38 is inserted into the outlet 36 and the ignition control circuit unit 30 is connected to the battery power source and the control unit.

As explained in the foregoing, the embodiment is configured to have the ignition coil 10 having the core 14, the coil unit 24 composed of the primary coil 20 and the secondary coil 22 disposed around the core and the coil case (outer case composed of a main case unit 12*a* and a case cover 12*b*) 12 housing the core and the coil unit, the core being openable at one end such that the coil unit is detachable from the core, wherein the primary coil and the secondary coil of the coil unit are fabricated of self-welding wire 200 and fixed in the coil case by the elastic material 26 (e.g., silicon gel).

Thus the core 14 is constituted to be openable at one end, the coil unit 24 composed of the primary coil 20 and the secondary coil 22 can be detached, the primary coil 20 and the secondary coil 22 are made of self-welding wire 200 and the coil unit 24 is fixed in the coil case by the elastic material 26. In other words, no resin is charged into the space 24*b* between the coil unit 24 and the main case unit 12*a* and a bobbin-less configuration can be realized owing to the use of the self-welding wire 200. When the ignition coil 10 is to be disposed of, therefore, the coil unit 24 can be readily removed and recovered. As a result, the recycle rate is increased to enable efficient resource recovery and reuse. The core can also be easily separated.

Owing to the fact that the primary coil 20 and the secondary coil 22 are fixed in the coil case by the elastic material (e.g., silicon gel) 26, which exhibits excellent vibration absorption properties, the ignition coil 10 can be imparted with vibration resistance that is equal to, if not better than, that of conventional ignition coils.

Although the use of the self-welding wire 200 causes adjacent turns of the copper wire 200*a* to be separated by the self-welding layer 200*c* (and the insulating layer 200*b*) and, as a result, reduces the number of turns per unit area, the required ignition voltage is ensured owing to the fabrication of the core 14 from gradient silicon steel plate members and the use of the flywheel 16 as part of the magnetic circuit.

On the other hand, the fact that adjacent turns of the copper wire 200*a* are in close proximity via the self-welding layer 200*c* (and the insulating layer 200*b*) means that the copper wire 200*a* enjoys a proportional improvement in air tightness and water tightness and, in turn, enhanced moisture resistance. The arrangement also improves insulation between adjacent turns of the copper wire 200*a*. As this reduces current leakage between the coil turns, it enables improvement in the ignition voltage characteristics, particularly achievement of a higher ignition voltage.

In the above, the ignition coil further includes the ignition control circuit unit 30 housed in the coil case (more specifically in the main case 12*a*), and wherein the ignition control circuit unit is fixed in the coil case by the elastic material 32. With this, when the ignition coil 10 is to be disposed of, therefore, the ignition control circuit unit 30 can be readily removed and recovered, further enhancing the recycle rate.

Owing to the fact that the ignition control circuit unit 30 is fixed by the elastic material (e.g., silicon gel) 32, which exhibits excellent vibration absorption properties, the ignition coil 10 can be imparted with vibration resistance that is equal to, if not better than, that of conventional ignition coils.

In the above, the primary coil and the secondary coil are integrally joined by the adhesive 24*a*. This increases insulation between the primary coil 20 and the secondary coil 22 and, by providing a unitary coil unit 24, facilitates assembly and improves the efficiency of ignition coil fabrication.

Moreover, the embodiment is configured to have an ignition coil having the coil unit 24 composed of the primary coil 20 with the terminal(s) 20*a*, 20*b* and the secondary coil 22, the ignition control circuit unit 30 with the lead(s) 30*a*, 30*b* to be connected to the terminal of the primary coil and the coil case housing the coil unit and the ignition control circuit unit, wherein the terminal(s) 20*a*, 20*b* of the primary coil 20 and the lead(s) 30*a*, 30*b* of the ignition control circuit unit 30 are joined together by fusion and the joint(s) is(are) partially molded (partially molded with the molding material 44).

This eliminates use of solder joints and makes it easier to comply with regulations regarding lead disposal. In addition, the partial molding with the molding material 44 makes the coil unit 24 still easier to remove and recover. The result is a higher recycle rate and highly efficient resource recovery and reuse. The partial molding with the molding material 44 also ensures that the joints are not deficient in moisture resistance and vibration resistance.

In the aforesaid,the secondary coil 22 has the terminal 22*a* to be connected to the terminal 36*a* of the high-tension cord outlet 36, and the terminal 22*a* of the secondary coil 22 and the terminal 36*a* of the high-tension cord outlet 36 are joined together by fusion and the joint is partially molded (partially molded with the molding material 46). This also makes it easier to comply with regulations regarding lead disposal, and the partial molding with the molding material 46 makes the coil unit 24 still easier to remove and recover. The recycle rate is therefore enhanced.

Further, the coil case houses the inner cap 34 which is formed integrally with the high-tension cord outlet 36 and is disposed on the same side where the terminals 20*a*, 20*b*, 22*a*, 22*b* of the primary coil 20 and the secondary coil 22 are disposed such that the fusing and partial molding of the terminals can be conducted on the inner cap. As this makes the inner cap 34 usable as a working surface, it facilitates the connection work, simplifies the fabrication process and enhances product reliability.

It should be noted that, in the ignition coil 10 described in the foregoing, the core 14 is disposed adjacent to the flywheel 16 and uses the flywheel 16 as part of the magnetic circuit. The invention is not limited to this configuration, however, and a closed magnetic circuit can instead be formed solely by the core 14.

While the invention has thus been shown and described with reference to specific embodiments, it should be noted that the invention is in no way limited to the details of the described arrangements but changes and modifications may be made without departing from the scope of the appended claims.

What is claimed is:

1. An ignition coil having a core, a coil unit composed of a primary coil and a secondary coil disposed around the core and a coil case housing the core and the coil unit, the core being openable at one end such that the coil unit is detachable from the core;

wherein the improvement comprises:

the primary coil and the secondary coil of the coil unit are fabricated of self welding wire and are partially fixed in the coil case by an elastic material such that the coil unit can easily be removed from the case when the ignition coil is to be disposed.

2. An ignition coil according to claim 1, further including:

an ignition control circuit unit housed in the coil case;

and wherein the ignition control circuit unit is partially fixed in the coil case by an elastic material such that the ignition control circuit unit can be easily removed from the case when the ignition coil is to be disposed.

3. An ignition coil according to claim 1, wherein the primary coil and the secondary coil are integrally joined by an adhesive to form the coil unit.

4. An ignition coil according to claim 2, wherein the primary coil and the secondary coil are integrally joined by an adhesive to form the coil unit.

5. An ignition coil according to claim 1, wherein the core is cut away at the opened end such that a flywheel of an internal combustion engine is used to form a closed magnetic circuit.

6. An ignition coil according to claim 5, wherein the core is cut away to give a same curvature of the circular shaped flywheel such that uniform spacing is maintained between the core and the flywheel.

7. An ignition coil having a coil unit composed of a primary coil with a terminal and a secondary coil, an ignition control circuit unit with a lead to be connected to the terminal of the primary coil and a coil case housing the coil unit and the ignition control circuit unit and having a case cover to be closed at its open end, wherein the improvement comprises:

the coil case houses an inner cap below the case cover; and the terminal of the primary coil and the lead of the ignition control circuit unit are joined together by fusion and the joint is partially molded such that the fusing and partial molding of the terminals can be conducted on the inner cap when the ignition coil is manufactured.

8. An ignition coil according to claim 7, wherein the secondary coil has a terminal to be connected to a terminal of a high-tension cord outlet, and the terminal of the secondary coil and the terminal of the high-tension cord outlet are joined together by fusion and the joint is partially molded such that the fusing and partial molding of the terminals can be conducted on the inner cap when the ignition coil is manufactured.

9. An ignition coil according to claim 8, wherein the inner cap is formed integrally with the high-tension cord outlet and is disposed on a same side where the terminals of the primary coil and the secondary coil are disposed such that the fusing and partial molding of the terminals can be conducted on the inner cap when the ignition coil is manufactured.

10. An ignition coil according to claim 7, wherein the coil unit is provided with a core which is cut away at the opened end such that a flywheel of an internal combustion engine is used to form a closed magnetic circuit.

11. An ignition coil according to claim 10, wherein the core is cut away to give a same curvature of the circular shaped flywheel, such that uniform spacing is maintained between the core and the flywheel.

* * * * *